United States Patent [19]

Leitch

[11] 3,952,790

[45] Apr. 27, 1976

[54] ARRANGEMENT FOR HATCH COVERS

[75] Inventor: George Leitch, Newcastle-upon-Tyne, England

[73] Assignee: MacGregor International, S. A., Basel, Switzerland

[22] Filed: Dec. 9, 1974

[21] Appl. No.: 531,198

[30] Foreign Application Priority Data

Dec. 7, 1973 United Kingdom ..... 56909/73

[52] U.S. Cl. ..... 160/193

[51] Int. Cl.[2] ..... E05F 11/06

[58] Field of Search ..... 160/188, 193; 114/201 R, 202

[56] References Cited

UNITED STATES PATENTS

| | | | |
|---|---|---|---|
| 2,780,197 | 2/1957 | Von Tell | 160/193 X |
| 3,127,925 | 4/1964 | Sjostrom | 160/193 |
| 3,199,576 | 8/1965 | Jericijo | 160/193 |
| 3,326,169 | 6/1967 | Beas | 114/202 |
| 3,465,807 | 9/1969 | Beas | 160/193 X |

*Primary Examiner*—Philip C. Kannan

*Attorney, Agent, or Firm*—Stevens, Davis, Miller & Mosher

[57] ABSTRACT

A cover arrangement for a container comprising two cover elements hinged and movable together to open and close the container under the action of pulling means attached to one of the cover elements, the pulling means acting through direction changing means to enable opening of the container to be carried out by an upward pull on the pulling means. A tripping lever provided on the same cover element as the pulling means extends towards the other cover element and a guide ramp cooperating with and guides the tripping lever in a downward direction to pivot the cover element bearing the tripping lever into a substantially vertical position on opening of the cover arrangement by the pulling means.

12 Claims, 5 Drawing Figures

ARRANGEMENT FOR HATCH COVERS

The present invention relates to cover arrangements for containers. The invention is particularly applicable to hatch covers for ships, but as will be clearly understood, cover arrangements according to the invention may be used in any suitable location or vehicle such as grain storage buildings or railway wagons.

A great need is at present being found for ships capable of carrying deck cargoes, e.g. containers, packaged lumber etc. and the like and many such ships have been, and are being built specifically for this purpose. A particularly requirement for ships of this nature is that they shall be capable of rapid loading and unloading, and it is also quite usual that every possible part of the weather-deck and 'tween-deck' area is used for cargo stowage; this includes the surface of hatch covers.

Given such conditions, it would be ideal to have large hatchways with their covers flush and level enough to support such cargoes as described above, and to be simple in operation. An obstacle to this has been that hatchcovers of the desired size are extremely heavy, often necessitating the use of dock or harbour facilities to move them, or specially installed winches on the ships themselves.

Such apparatus is expensive, and adds undesirably to deck furniture.

SUMMARY OF THE INVENTION

It is an object of the present invention to provide a cover arrangement for containers, e.g. hatch covers for ships, which cover arrangements can be suitable for use on relatively large size apertures and can be operated with relatively inexpensive equipment.

It is an object of the invention to provide hatch covers for ships, which covers can be of large size and level surface, but are yet capable of being moved by derricks and/or cranes of the type commonly found in ships.

According to the invention there is provided a cover arrangement for a container comprising first and second cover elements hinged together and movable together to open and close the container, pulling means attached to said first cover element and direction changing means, through which the pulling means passes on said second cover element, to enable opening of the container to be carried out by applying an upward pull on said pulling means after it has passed through said direction changing means, a tripping lever on said first cover element extending in the direction of said second cover element, and guide ramp means cooperating with said tripping lever to guide said tripping lever in a downward direction, and to pivot said first cover element, with the assistance of said pulling means, into a substantially vertical position on opening of the cover arrangement.

A preferred embodiment of the invention, applied to hatch covers for ships, will now be described by way of example with reference to the accompanying drawings, in which.

Like numerals identify the same or similar references in the several views.

DESCRIPTION OF THE PREFERRED EMBODIMENTS

Figure 1:
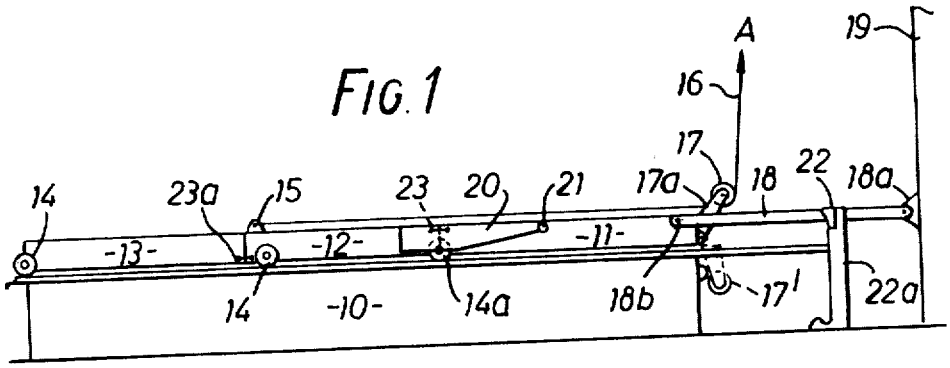
FIG. 1 is a diagrammatic side view of a hatchway fitted with three hatch covers according to the invention, in the closed position.

Referring to the drawings, hatch coaming 10 supports three hatch cover elements, henceforth described as panels 11, 12, 13 which are adapted to be movable upon guided wheels **14, 14*a* flanged or plain, which run on the coaming rest bar at each side, beamwise, of the coaming 10. An attachment point 15 is provided upon one end of panel 12 remote from the stowage end X (FIG. 3) of the hatchway, and takes one end of an operating wire rope or chain 16 which is led in the hatchway opening direction over the top of panel 11 to a pulley 17 which, in the embodiment is mounted upon a pivotable arm 17*a* which allows the pulley to be stowed below the level of the top of the cover when not in use. This can be seen in broken line in FIG. 1 at 17'**.

Wire 16 passes around pulley 17 to connect eventually with a derrick or crane (not shown) in the direction of arrow A in the drawings.

A pair of locating arms 18 are pivotably secured at one end **18*a* to structure 19, which may be any suitable part of the ship's deck furnishings or may be a purpose-built structure: at the other end 18*b* of the locating arms, they are pivotably secured, one at each side of panel 11.**

Figure 2:
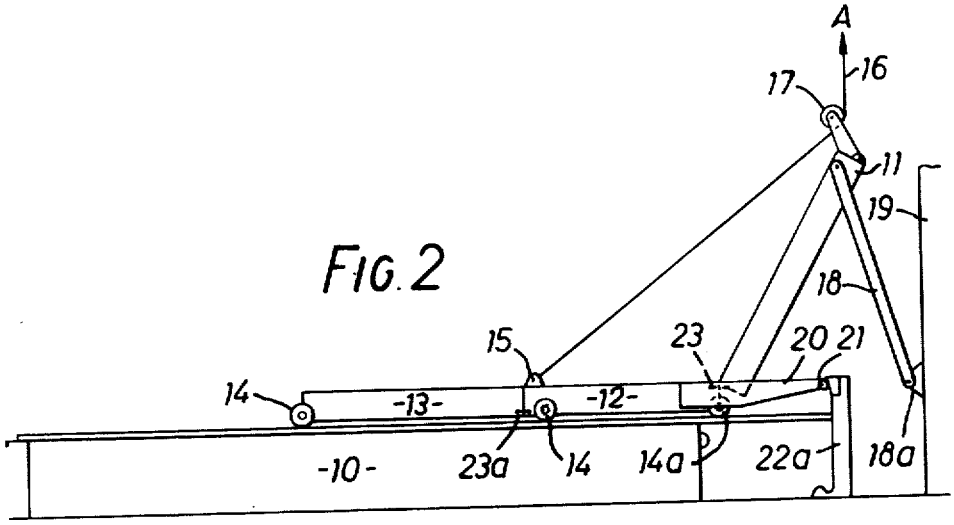
FIG. 2 is a similar view showing the hatch covers partly opened.
Figure 4:
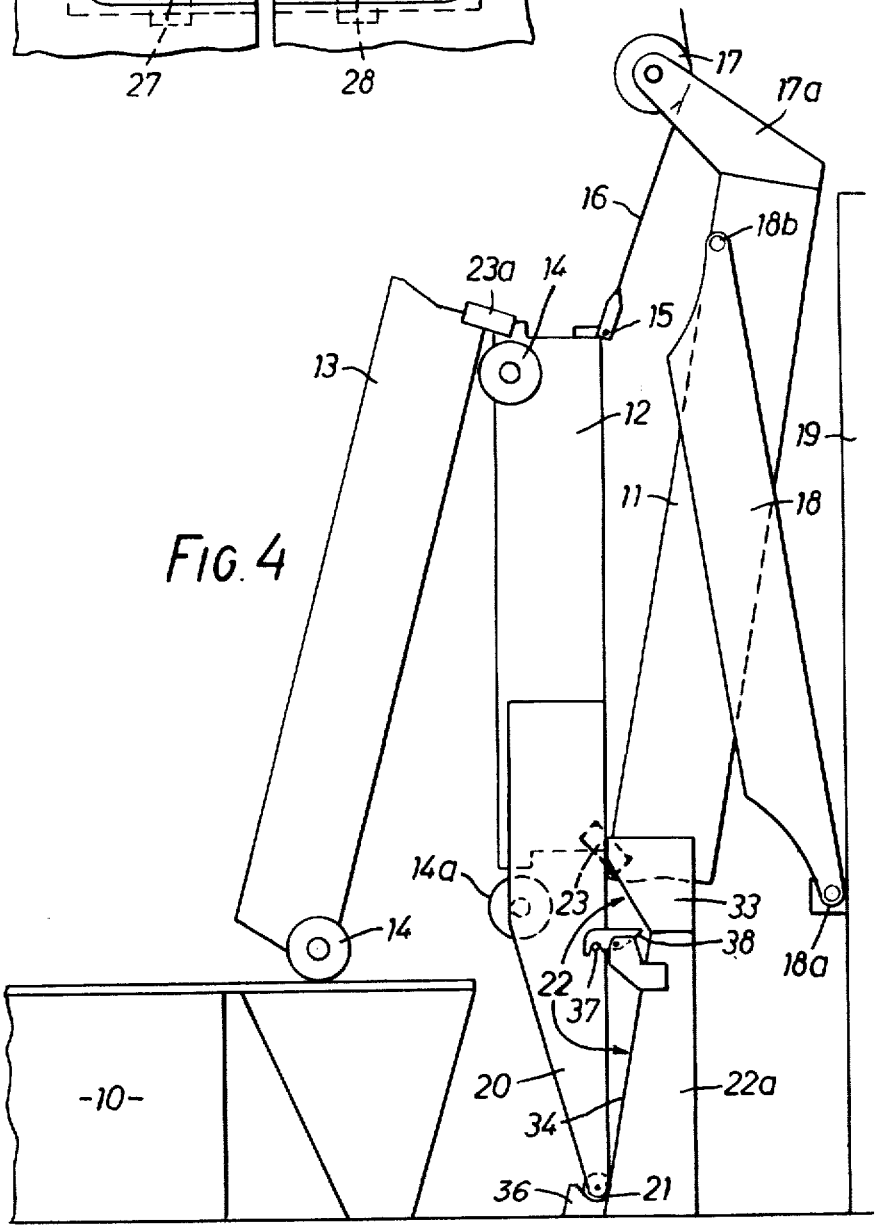
FIG. 4 is a fragmentary view to an enlarged scale of a part of FIG. 3 showing details of a catch mechanism.

Panel 12 carries trip levers 20 which extend as part of or as an attachment to each side of this panel, although only one of the levers 20 is shown in the drawings. At the leading end (in the direction of opening) of each trip lever is a roller 21 which is so set as to meet one of a pair of guide-ramps 22 when the hatch covers 11, 12, 13 have moved to the appropriate stage in the opening movement (See FIG. 2). This arrangement is shown in greater detail in FIG. 4 which shows this part of the arrangement in the open position. From this figure can be seen that the guide ramps 22 are formed by a buffer portion 33 at the upper end and a straight portion 34 at the lower end ending in a roller cup 36 for the roller 21. The trip levers are provided with projections 37 which cooperate with a manual/automatic catch 38 mounted on the parts **22*a* carrying the guide ramps. This is so arranged that, on opening of the hatch cover, the projections 37 automatically engage in the catch 38. Release of the catch 38** is then carried out by hand when it is desired to close the hatch cover.

Guide ramps 22 are set upon posts **22*a*, which are suitably fixed adjacent to the coaming 10.**

Figure 5:
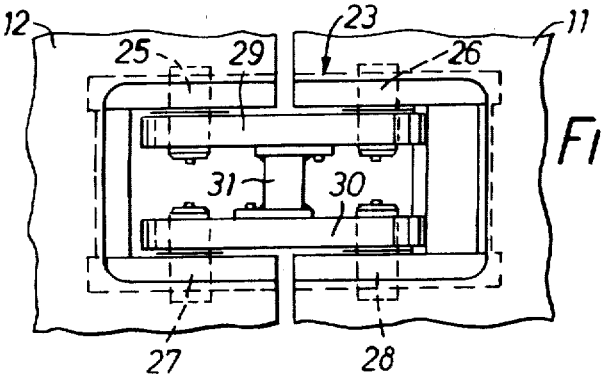
FIG. 5 is a plan view of the top hinge arrangement connecting the middle and front hatch cover elements.

Panels 11, 12, 13 are connected to one another by means of hinges **23, 23*a*. As can be seen, the hinge 23 connects the panel 11 and 12 at their upper adjacent edges and the hinge 23*a* connects the panels 12 and 13 at their lower adjacent edges. The hinge 23 is shown in greater detail in plan view in FIG. 5. This hinge comprises four hinge pins 25, 26, 27, 28 the pins 25 and 27 being carried by the hatch panel 12 and the pins 26 and 28 being carried by the hatch panel 11. Each pair of pins 25, 26, and 27, 28, is connected by a plate member 29 or 30 respectively which pivots on the pins. The two plate members 29 and 30 are constrained to move together by a connecting piece 31. During opening and closing operations, hinge 23 pulls and pushes panels 12 and 13, supports panel 11, and controls the stowed attitude of panels 11 and 12. In the closed hatch condition it is flush with the top of the panels. Hinge 23***a* may also be similarly constructed or one or both of these hinges may be replaced by other suitable forms of hinge.

In operation, the opening procedure is as follows: the operating wire, rope or chain 16 is rigged as described above, and any manual hatch cover locks and the like are released. A pull is exerted upon the operating wire, rope or chain, and panel 11 pivots upwards about pivot-point 23 (which is a hinge) pulling behind it panels 12 and 13 which move upon wheels 14, 14*a*, this action releasing seal and automatic locks if provided. At the same time locating arms 18 control the movement of panel 11 by their attachment at points 18*a*, 18*b*.

As the appropriate stage of opening is reached, during raising of the panel 11 towards the vertical, trip levers 20 contact guide-ramps 22 and are guided thereby in a downward direction, i.e. towards deck-level whilst panel 12 rotates in a clockwise arc (relative to the drawings) initially about the moving wheel 14*a* assisted by the pulling action of the wire, rope or chain 16. The rearmost end of panel 12 carries with it the leading end of panel 13, the rearmost end of which, in turn, rests upon its wheels 14. When the roller 21 on trip lever 20 engages with a cup at the base of posts 22*a* this then becomes the fulcrum point and the wheels 14*a* lift off the coaming top.

The pull upon operating wire, rope or chain 16 is maintained until the three panels have completely cleared the hatchway opening, at which stage automatic latches 38 are engaged on projections 37 on trip lever 20 (FIG. 4) holding the panels in their "open" disposition.

Figure 3:
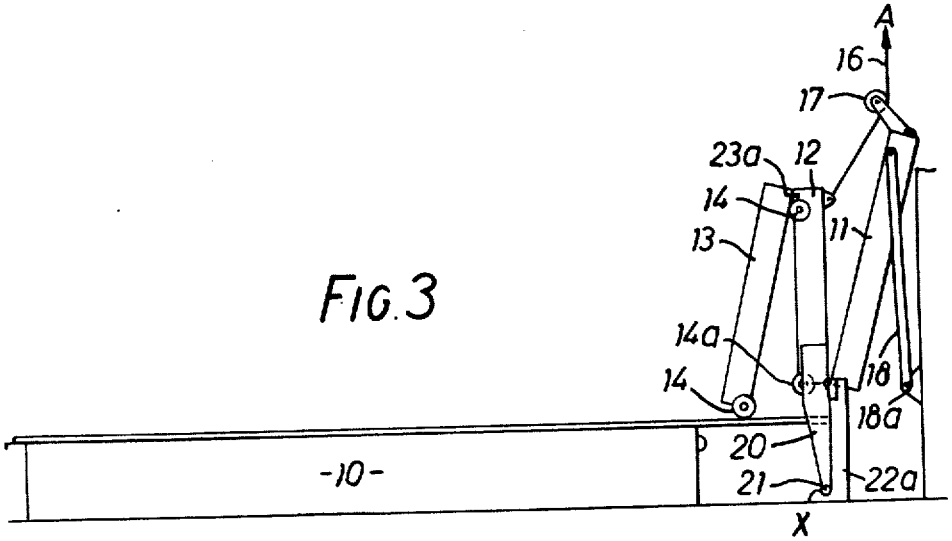
FIG. 3 is a similar view showing the hatchway fully open with the hatch covers in the stowed position.

No further apparatus is required to close the panels. After manually releasing the latches 38, the operating wire 16 is merely paid out with the panels' own weight carrying them back to their starting, or "closed" positions. This movement is however, advantageously assisted by the centre of gravity of panel 12 being to the left of trip lever 20 (as seen in FIG. 3) to permit a toppling movement to occur when the support of the operating wire is removed.

The closing movement is further assisted by the action of trip levers 20 having rotated panel 11 from its fully stowed position such that the weight of panel 11 now becomes a driving force assisting to fully close the hatchway.

The guide-ramps 22 are suitable buffered by the buffer portion 33 so that they may accommodate the shock of being struck by the trip levers 20 during movement of the panels. They may therefore include hydraulic shock-absorbers of known type, or may be faced at the contact point with a resilient material e.g. rubber. The said material may be in hollow cushion-like formation or may be of bag-like construction filled with a suitable fluid e.g. water or with a foamed plastics material. These buffers may be arranged to be compressed by the trip lever 20 when the panels are fully stowed and therefore further assist the initial closing movement.

By the use of an arrangement of hatchcovers constructed as above described, a normal ship's derrick or crane may be used for the opening and closing procedure. The simple rigging arrangement employed (i.e. without pullies specially fitted upon the ship structure) ensures that, for any specific set of hatch covers of this type, the relationship between effort and wire movement required can be optimised.

For still more stowage area, the location arms may be formed by a further panel covering at least part of the area between them, and forming a surface capable of supporting cargo, e.g. containers of conventional type.

The geometry of this system, i.e. the relationship of hinge and pivot centres, is arranged to ensure that movement of any part of the cover structure or fittings, when opening, does not take place away from the direction of stowage, beyond their position when at rest in the hatch closed condition, thus ensuring any sealing gaskets are not compressed beyond the designed characteristics when the covers are in the final closed position.

Furthermore, the closing movement may incorporate a specific action allowing the sealing and locking of the transverse joints between panels 11 and 12, 12 and 13, longitudinal sides of panels 12 and 13, and the end of panel 13 remote from stowage, to be fully automatic.

Any suitable locking arrangement may be employed to lock and/or weather-seal the panels when they are in the closed position, both to the themselves and to the coaming of the hatchway. One such suitable arrangement is that sold under the Trade Mark "ROLLTITE" by the present Applicants.

Although the invention has been described as an arrangement of three panels, the operation of it remains virtually identical for an arrangement of only two panels. For arrangements of more e.g. four, five or more panels, similar operation can be achieved with suitable modifications. such modifications may include suitable positioning of the attachment point for the operating wire and/or suitable constructional arrangements. For example, it may be convenient to position the attachment point upon the free end of an extension arm pivotably secured to the penultimate panel in the line as they move towards opening.

To assist the closing action, there may, if desired, be provided a compression spring, ram or the like at a point where it will be contacted and compressed by one or more of the panels when the latter is in the stowed (hatchway open) position, and urge the panel(s) towards the closed position. Conveniently, the spring or ram (which may be power-operated or released) is fixed upon the support structure 19 where it can be compressed by panel 11 or by part of the locating arms 18, or a panel (hingedly connected at at least one end to panel 11) which may replace the latter.

Although the hatch cover system described above is based on the use of normal ships derricks or cranes, if such equipment is not available, suitable arrangements can be incorporated to provide rigging from alternative sources, e.g. mooring winches, shore cranes etc.

The present invention although described and illustrated for a weather-deck cover can readily be applied to flush tween-deck covers with suitable modifications.

As previously mentioned, while the cover arrangement has been described as particularly applicable to ships hatches, it can nevertheless be used in other locations such as on railway wagons or grain storage buildings.

It will be understood that the above description of the present invention is susceptible to various modification changes and adaptations.

What is claimed is:

1. A cover arrangement for a container comprising first and second cover elements hinged together and movable together to open and close the container, pulling means attached to said first cover element and direction changing means, through which the pulling means passes on said second cover element, to enable opening of the container to be carried out by applying an upward pull on said pulling means after it has passed through said direction changing means, a tripping lever on said first cover element extending in the direction of said second cover element, and guide ramp means cooperating with said tripping lever to guide said tripping lever in a downward direction, and to pivot said first cover element, with the assistance of said pulling means, into a substantially vertical position on opening of the cover arrangement.

2. An arrangement as defined in claim 1, wherein at least one of said hinge means comprise dual center hinges having first and second pivots mounted on adjacent ones of the cover elements, which pivots are spaced by a distance sufficient to prevent, during opening, the compression of any associated sealing gaskets greater than that which occurs on closing the cover arrangement.

3. An arrangement as claimed in claim 1, wherein the container comprises the hold of a ship having an opening formed by an access hatch and the cover arrangement comprises a hatch cover movable to open and close the access hatch.

4. An arrangement as defined in claim 1, and comprising automatic latches for retaining said tripping lever in its downward position to retain the covering arrangement in the open position.

5. An arrangement as defined in claim 1 and comprising an arrangement of said cover elements and said tripping lever for moving said tripping lever into engagement with said guide ramp means during movement of said second cover member from its horizontal closed position to a position towards the vertical.

6. An arrangement as defined in claim 1 and comprising a locating arm pivoted at one end to said second cover element and at its other end to a stationary member for guiding movement of said second cover element.

7. An arrangement as defined in claim 1 and comprising a third cover element and movable with said first cover element and hinged to said first cover element on the opposite side of said first cover element to said second cover element.

8. An arrangement as defined in claim 7, and comprising elements forming said first, second and third cover elements adapted to be flat and horizontal in container closing position and rollers on which said cover elements are guided when moving between said container closing positions and open positions.

9. An arrangement as defined in claim 8, and comprising first hinge means for hinging said first and second cover elements together at upper adjacent edges and second hinge means for hinging said first and third cover elements together at lower adjacent edges.

10. An arrangement as defined in claim 1 wherein said pulling means comprises a rope, wire or chain and said direction changing means comprises a pulley and pulley arms carrying said pulley at the end of said second cover element away from said first cover element.

11. An arrangement as defined in claim 10 and comprising means for attachment of said rope, wire or chain to said first cover element at its end away from said second cover element.

12. An arrangement as defined in claim 10 and comprising pivot means for pivoting said pulley arms between an operative position in which said pulley stands proud of the upper surface of said second cover element and an inoperative position in which said pulley takes up a position below the upper surface of said second cover element.

* * * * *